US005209465A

United States Patent [19]

Sayama et al.

[11] Patent Number: 5,209,465

[45] Date of Patent: May 11, 1993

[54] SHEET FEEDING APPARATUS

[75] Inventors: Hideaki Sayama, Yokohama; Junichi Sata, Kawasaki, both of Japan

[73] Assignee: Canon Kabushiki Kaisha, Tokyo, Japan

[21] Appl. No.: 826,668

[22] Filed: Jan. 29, 1992

Related U.S. Application Data

[63] Continuation of Ser. No. 458,395, Dec. 28, 1989, abandoned.

[30] Foreign Application Priority Data

Dec. 28, 1988 [JP] Japan ..... 63-332644
Dec. 29, 1988 [JP] Japan ..... 63-330984
Dec. 29, 1988 [JP] Japan ..... 63-330985

[51] Int. Cl.[5] ..... B65H 7/08

[52] U.S. Cl. ..... 271/110; 271/117; 271/118; 271/122; 271/273

[58] Field of Search ..... 271/110, 114, 116, 117, 271/118, 119, 122, 126, 265, 273, 37

[56] References Cited

U.S. PATENT DOCUMENTS 3,567,214 3/1971 Crandell et al. ..... 271/10
4,085,931 4/1978 Szeluga et al. ..... 271/265
4,262,894 4/1981 Marano ..... 271/4
4,589,650 5/1986 Miyoshi ..... 271/122 X
4,928,951 5/1990 Fukui ..... 271/122 X

FOREIGN PATENT DOCUMENTS 0320246 6/1989 European Pat. Off. .
3334522 3/1984 Fed. Rep. of Germany ..... 271/126
48-96023 12/1973 Japan .
56-52344 5/1981 Japan .
60-204566 10/1985 Japan .
61-27841 2/1986 Japan .
63-123742 5/1988 Japan .
2-86518 3/1990 Japan .

OTHER PUBLICATIONS 2 pp. European Search Report.

*Primary Examiner*—H. Grant Skaggs
*Assistant Examiner*—Carol Lynn Druzbick
*Attorney, Agent, or Firm*—Fitzpatrick, Cella, Harper & Scinto

[57] ABSTRACT

The present invention provides a sheet feeding apparatus with a supporting member for supporting stacked sheets; a feed roller for feeding the sheets stacked in the support member; a driver for generating rotational forces in a predetermined direction and in an opposite direction opposite to the predetermined direction; and a shifter for shifting the feed roller to a position where the feed roller contacts the sheet stacked in the supporting member by the rotational force directed toward the predetermined direction, and for separating the feed roller from the sheet stacked in the supporting member by the rotational force directed toward the opposite direction. The shifter includes a driving force transmitter for transmitting the rotational force directed toward the predetermined direction by a first predetermined value and for transmitting the rotational force directed toward the opposite direction by a second predetermined value, whereby the feed roller is shifted by the rotational force transmitted by the driving force transmitter.

21 Claims, 11 Drawing Sheets

SHEET FEEDING APPARATUS

This application is a continuation of application Ser. No. 07/458,395 filed Dec. 28, 1989, now abandoned.

BACKGROUND OF THE INVENTION

1. Field of the Invention

The present invention relates to a sheet feeding apparatus adapted to feed a sheet to an image forming portion or an image reading portion of an image processing system such as a copying machine, facsimile, printer and the like.

2. Related Background Art

In conventional sheet feeding apparatuses, as a driving source for shifting a pick-up roller toward and away from a sheet, a solenoid was used (as disclosed in the Japanese Patent Laid-Open No. 48-96023) or a cam was used (as disclosed in the Japanese Patent Publication No. 62-19330).

However, in the conventional sheet feeding apparatus disclosed in the above Japanese Patent Laid-Open No. 48-96023, another solenoid for separating the pick-up roller from the sheet is provided, independently of the driving source for rotating the pick-up roller. On the other hand, in the conventional sheet feeding apparatus disclosed in the above Japanese Patent Publication No. 62-19330, clutches are arranged between the driving source and the pick-up roller and between the driving source and the cam for separating the pick-up roller from the sheet.

In either cases, the conventional apparatuses use the clutches or solenoids in order to ensure the rotation of the pick-up roller and the separation of the pick-up roller from the sheet, and, thus, have the following problems:

(1) the control is complicated, (2) the capacity of the power source must be increased, and (3) the construction or structure is complicated.

The U.S. Pat. No. 4,262,894 and the Japanese Patent Laid-Open No. 60-204566 disclose a sheet feeding apparatus wherein a pick-up roller is attached to a pivotable arm and the pivotable arm is pivoted or rocked by a motor through a friction clutch so that the arm is shifted toward and away from the sheet. In these conventional sheet feeding apparatuses, the friction clutch is so designed that a required torque can be transmitted to the pick-up roller when the pick-up roller is lifted (i.e., separated from the sheet). In this case, however, when the pick-up roller is lowered (i.e., engaged with the sheet), nevertheless a torque less than that required in the lifting of the pick-up roller is required, the friction clutch is slipped by a more excessive force than the required one after it has contacted the sheet, and, thus, the driving force is consumed wastefully. Particularly, when a single motor is used for supplying the driving force not only to lift and lower the pick-up roller, but also to rotate the pick-up roller and other rollers, the consumption of such wasteful driving force reduces the supply of the driving power to other rollers and also reduces rotational speeds of the rollers, thus resulting in the poor or erroneous feeding of the sheet. In order to avoid this, if a large motor is used, the overall dimension of the sheet feeding apparatus itself will be large-sized and the consumption of electric power will also be greatly increased.

SUMMARY OF THE INVENTION

The present invention aims to solve the above-mentioned conventional problems, and, accordingly, an object of the present invention is to provide a sheet feeding apparatus which has a simple construction and wherein the control therefor is simplified and the whole load is small.

Another object of the present invention is to provide a sheet feeding apparatus wherein the number of driving sources is minimized, the loss of the driving force is reduced, the apparatus itself is compacted, and the consumption of electric power is reduced.

The other object of the present invention is to provide a sheet feeding apparatus which does not need the complicated control.

DETAILED DESCRIPTION OF THE PREFERRED EMBODIMENTS

The present invention will now be explained in connection with embodiments thereof with reference to the accompanying drawings.

Hereinafter, the present invention is explained as examples that the invention is applied to an automatic original feeding apparatus, but the present invention is not limited to such original feeding apparatus, and can be applied to a sheet feeding apparatus for feeding any sheet.

Figure 1:
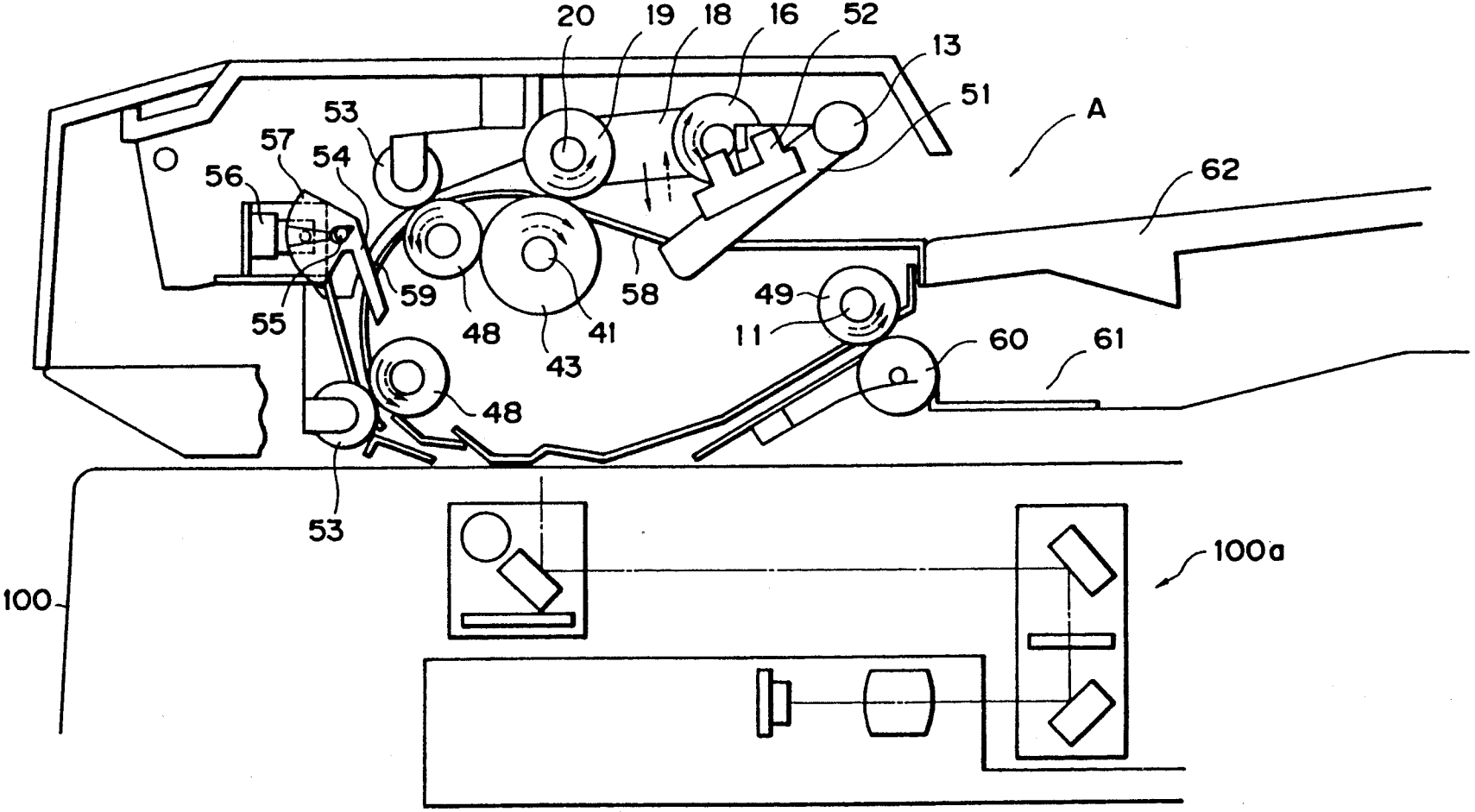
FIG. 1 is a schematic sectional view of a sheet feeding apparatus according to a preferred embodiment of the present invention.
Figure 2:
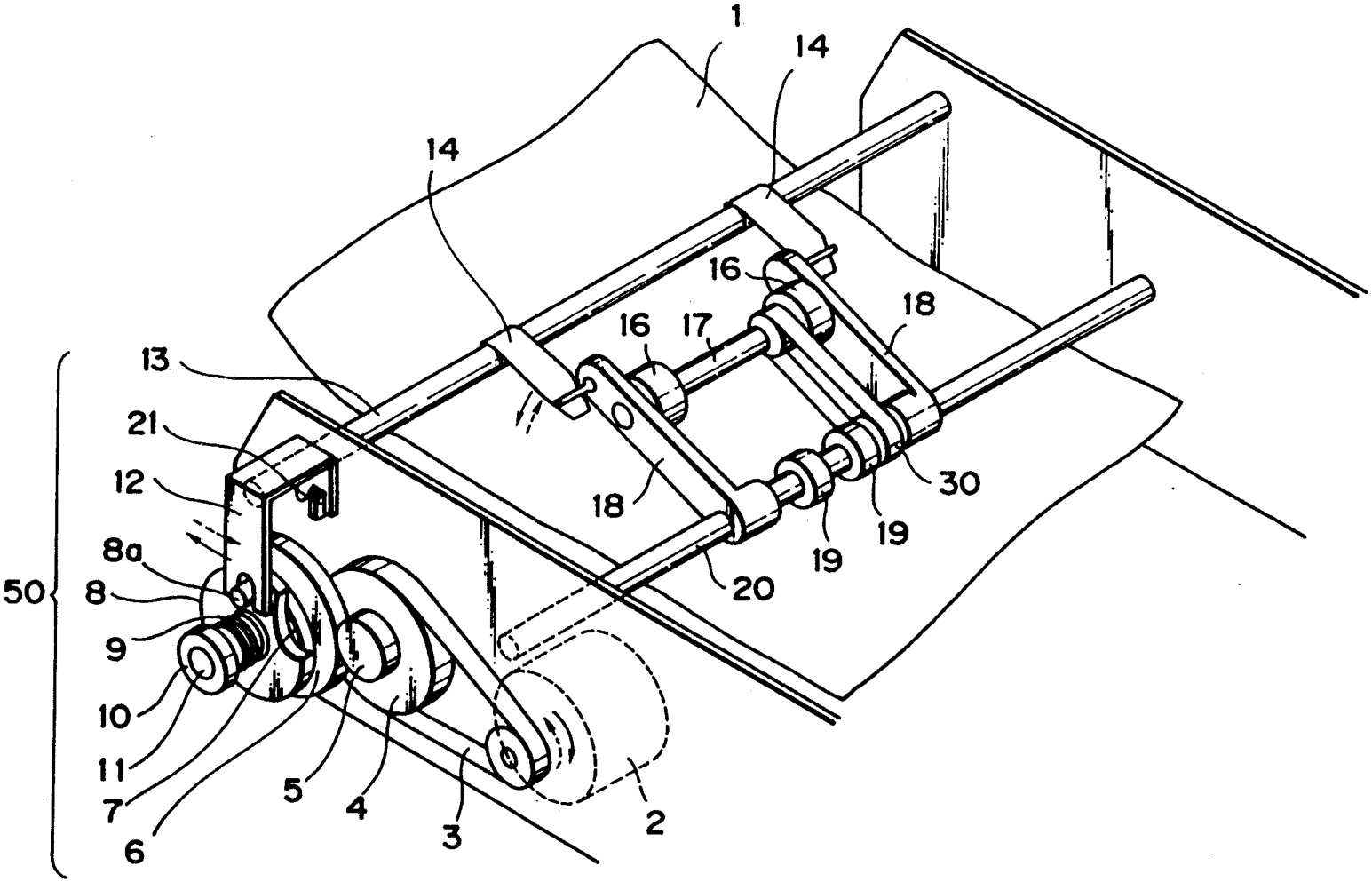
FIG. 2 is a schematic perspective view of the sheet feeding apparatus of FIG. 1.
Figure 3:
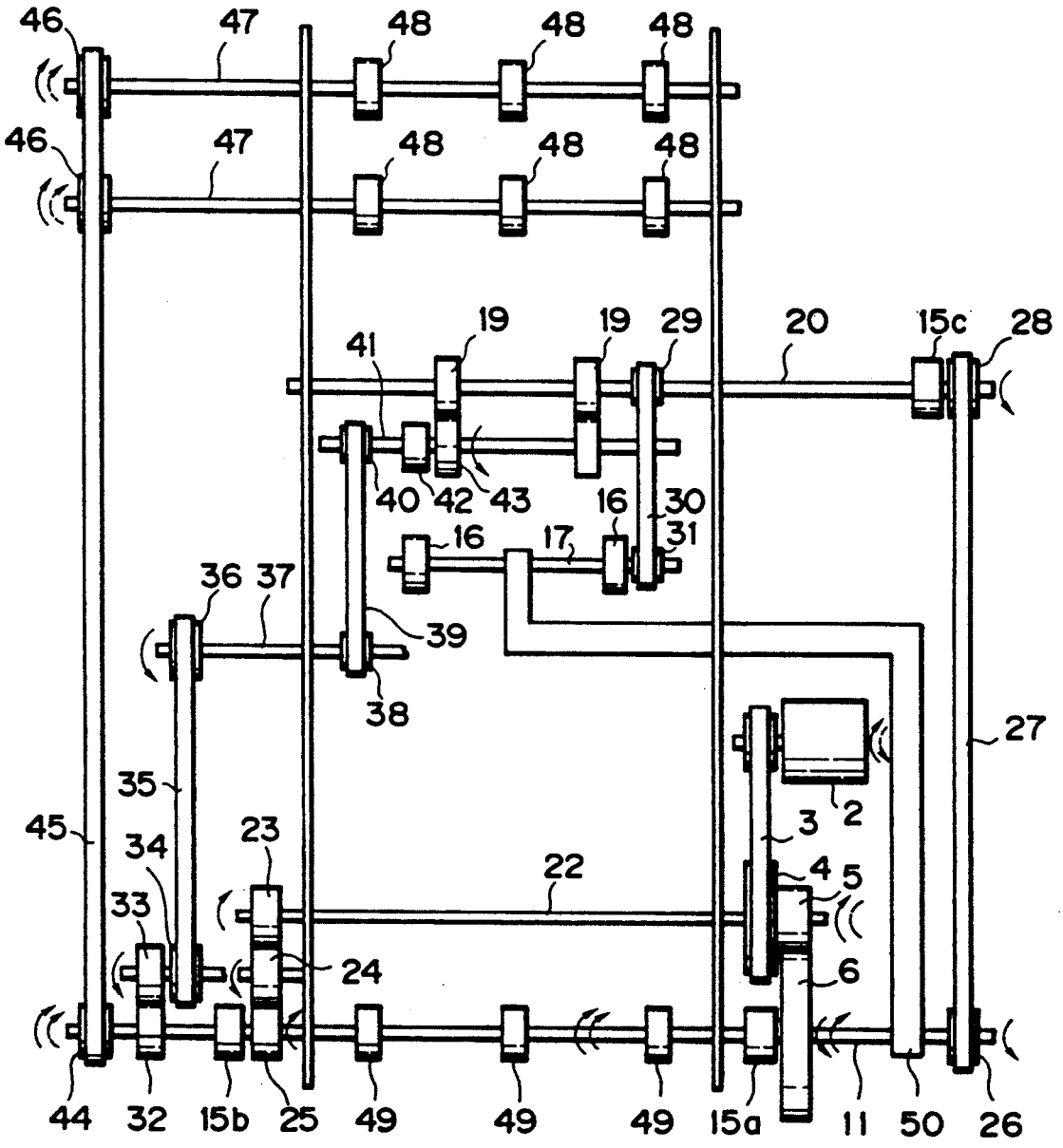
FIG. 3 is an explanatory view for explaining a driving mechanism of the sheet feeding apparatus of FIG. 1.

FIG. 1 is a sectional view of an automatic original feeding apparatus, FIG. 2 is a perspective view of the original feeding apparatus, and FIG. 3 shows a driving mechanism for the original feeding apparatus.

In FIGS. 1 to 3, the reference numeral 1 denotes an original to be fed; 2 denotes a motor for driving the whole apparatus; 3 denotes a belt for transmitting a driving force of the motor 2; 4 denotes a pulley; 5 denotes a gear fixedly mounted coaxially with the pulley 4 and rotated in the same direction as the pulley 4; 6 denotes a gear meshed with the gear 5; 7 denotes a friction pad attached to the gear 6; 8 denotes a friction link; 9 denotes a spring urging the friction link 8 against the friction pad 7; 10 denotes a collar for holding down the spring 9 and fixed to one end of a shaft 11 of ejector rollers, which can be rotated by a driving force from the gear 6.

The reference numeral 22 denotes a driving shaft which can be rotated by the driving force from the pulley 4; 23 denotes a gear attached to the driving shaft 22; 24 denotes a gear meshed with the gear 23; 25 denotes a gear meshed with the gear 24 and fixed to the ejector roller shaft 11; and 15*a*, 15*b* denote one-way clutches each of which can transmit a rotational force only in one direction and can be slipped in the other direction. These one-way clutches 15a 15b are arranged on the ejector roller shaft 11.

The reference numeral 13 denotes a rocking shaft; 12 denotes a rocking plate attached to the rocking shaft 13 and engaged by a projection 8a of the friction link 8; 16 denotes pick-up rollers for picking up the original 1; 17 denotes a shaft of the pick-up rollers 16; 18 denotes arms for supporting the pick-up roller shaft 17; and 14 denotes support plates attached to the rocking shaft 13, which support plates 14 support the arms 18 for up-and-down movement through the rocking movement of the rocking shaft 13.

The reference numeral 26 denotes a pulley fixed to the ejector roller shaft 11 to be rotated in the same direction as the gear 6; 27 denotes a belt for transmitting the rotation of the pulley 26 to a pulley 28 which is connected to a shaft 20 of sheet feed rollers 19 through a one-way clutch 15c; 29 denotes a pulley fixedly mounted on the feed roller shaft 20; and 30 denotes a belt for transmitting the rotation of the pulley 29 to a pulley 31 fixed to the pick-up roller shaft 17.

The reference numeral 32 denotes a gear fixed to the ejector roller shaft 11 to be rotated in the same direction as the shaft 11; 33 denotes a gear meshed with the gear 32; 34 denotes a pulley mounted to be rotated in the same direction as the gear 33; 35 denotes a belt for transmitting the rotation of the pulley 34 to a pulley 36 fixed to a transmission shaft 37; 38 denotes a pulley fixed to the transmission shaft 37 for transmitting the rotation of the transmission shaft 37 to a pulley 40 through a belt 39, which pulley 40 is fixed to a separation driving shaft 41; 42 denotes a torque limiter attached to the separation driving shaft 41, which torque limiter acts to transmit the rotational force of the separation driving shaft by a predetermined amount thereof or less; and 43 denotes reverse rollers.

The reference numeral 44 denotes a pulley attached to the ejector roller shaft 11 to be rotated in the same direction as the shaft 11; 45 denotes a belt for transmitting the rotation of the pulley 44 to pulleys 46 fixed to shafts 47 of conveying rollers 48; 49 denotes ejector rollers; 50 denotes an actuator means for lifting and lowering the pick-up rollers 16; 51 denotes an original detecting lever arranged at an upstream side (right in FIG. 1) of an original feeding direction and rotated around the rocking shaft 13, and 52 denotes an original detecting sensor for detecting the presence of the original 1 by detecting the posture of the detecting lever 51. The detecting sensor 52 may comprise a magnetic sensor, a microswitch or the like.

Next, the operation of the automatic original feeding apparatus according to the present invention will be explained.

When the original 1 is introduced into an entrance A, the original detecting lever 51 fixed to the rocking shaft 13 is rotated around the rocking shaft 13 by a pushing force from the leading edge of the original, whereby the original detecting sensor 52 judges that the original is present. Consequently, the motor 2 is rotated in a reverse direction (direction shown by the broken arrow in FIG. 2), so that the driving force of the motor is transmitted to the gear 6 through the belt 3, pulley 4 and gear 5, and then is transmitted to the ejector roller shaft 11 through the one-way clutch 15a. On the other hand, the driving force of the motor 2 is also transmitted from the pulley 4 to the driving shaft 22 and then is transmitted to the gear 25 through the gears 23, 24. However, in this case, since the one-way clutch 15b is slipped, the latter driving force cannot be transmitted to the ejector roller shaft 11. Although opposite driving forces are transmitted to the ejector roller shaft 11 at both ends thereof, since there are arranged one-way clutches 15a, 15b on both ends of the shaft 11, only one of the opposite driving forces is transmitted to the shaft 11 through the one of the one-way clutches, whereas the other driving force is not transmitted to the shaft 11 due to the slip of the other one-way clutch. Accordingly, the ejector roller shaft 11 is rotated always in one direction.

When the motor 2 is rotated in the reverse direction, the one-way clutch 15b near the gear 25 is slipped, whereas the one-way clutch 15a near the gear 6 is placed under the driving force transmitting condition. In this case; the conveying rollers 48 are driven to feed the original and the ejector rollers 49 are driven to eject the original. The rotation of the gear 6 is transmitted through the friction pad 7, friction link 8 and rocking plate 12 to the rocking shaft 13 to lift the support plates 14. After the motor 2 has been rotated for a predetermined time set by a timer or by counting the number of pulses of the pulse motor, the motor is stopped, thus establishing an original feedable condition.

In this condition, when an original feeding start button 80 is depressed or when a feeding signal is given, the motor 2 is rotated in a normal direction (direction shown by the solid arrow in FIG. 2). The driving force of the motor 2 is transmitted to the rocking shaft 13 through the belt 3, pulley 4, gears 5, 6, friction pad 7, friction link 8 and rocking plate 12 to lower the support plates 14, thus contacting the pick-up rollers 16 with the original 1. The rotation of the motor 2 is also transmitted to the sheet feed rollers 19 through the pulley 26 rotated in the same direction as the gear 6, belt 27, pulley 28, one-way clutch 15c, and feed roller shaft 20, and, further is transmitted to the pick-up rollers 16 through the pulley 29, belt 30, pulley 31 and pick-up roller shaft 17. By receiving the rotational force from the motor 2 in this way, the pick-up rollers 16 are begun to contact the original 1 and feed the same while rotating in the original feeding direction. The rotation of the ejector roller shaft 11 is transmitted to the reverse rollers or separating rollers 43 through the gears 32, 33, pulley 34, belt 35, pulley 36, transmission shaft 37, pulley 38, belt 39, pulley 40, separation driving shaft 41 and torque limiter 42. Further, the rotation of the ejector roller shaft 11 is also transmitted to the conveying rollers 48 through the pulley 44, belt 45, pullets 46 and conveying roller shafts 47.

While rotating the pick-up rollers 16 are lowered and contacted with the original thereby feeding the original 1 to a separating portion constituted by the feed rollers 19, separating rollers 43 and the like. The original 1, separated one by one by the feed rollers 19 and the separating rollers 43, is conveyed by the conveying rollers 48 and counter rollers 53. When the leading edge of the original rotates an original tip end detecting lever 54 around a pivot shaft 55, an original tip end detecting sensor 56 is turned OFF, thus detecting the tip end of the original. The original tip end detecting lever 54 is biased by a spring 57 so that the free end of the lever 54 is abutted against a hole 59 formed in an original guide 58.

When the original 1 is detected by the original tip end detecting sensor 56, the motor 2 is rotated reversely, with the result that the belt 3, pulley 4, gear 5, gear 6, driving shaft 22, gears 23, 24, 25, pulley 26, belt 27 and pulley 28 are rotated reversely (in directions shown by the broken arrows in FIGS. 1-3). In this case, since the one-way clutch 15c mounted on the feed roller shaft 20 is placed in the slipped condition, the driving force is not transmitted to the feed roller shaft 20. On the ejector roller shaft 11, since the one-way clutch 15b near the gear 25 is placed under the slipped condition, and the one-way clutch 15a near the gear 6 is placed under the driving force transmitting condition, the rotational direction of the ejector roller shaft 11 does not change if the rotational direction of the motor 2 is changed. Since the rotational direction of the gear 6 is reversed, the driving force is transmitted to the rocking shaft 13 through the friction pad 7, friction link 8, and rocking plate 12 to lift the support plates 14, thus separating the pick-up rollers 16 from the original 1.

A rocking range of the rocking plate 12 is limited by a stopper 21 so that, when the rocking plate 12 abuts against the stopper 21, the friction pad 7 and friction link 8 are slipped not to transmit the driving force to the rocking shaft 13. When the original 1 is detected by the original tip end detecting sensor 56, the rotational direction of the motor is reversed, thereby separating the pick-up rollers 16 from the original 1.

The separating rollers 43 rotated by the ejector roller shaft 11 through the gears 32, 33, pulley 34, belt 35, pulley 36, transmission shaft 37, pulley 38, belt 39, pulley 40, separation driving shaft 41 and torque limiter 42, the conveying rollers 48 rotated through the pulley 44, belt 45, pulley 46 and conveying roller shaft 44, and the ejector rollers 49 are rotated in a given direction, respectively, regardless of the rotational direction of the motor 2.

When a predetermined time $t_1$ has elapsed after the motor 2 has been reversed, an image reading device 100 starts to read an image on the original. When the original 1 has passed the original tip end detecting lever 54, this lever 54 is rotated around the pivot shaft 55 by the spring 57, whereby the free end of the lever is abutted against the hole 59 of the original guide 58, thereby turning the original tip end detecting sensor 56 ON. When a further predetermined time $t_1$ has elapsed, the reading of the image is completed. When a time $t_2$, during which the original 1 is conveyed by the ejector rollers 49 and counter rollers 60 and reaches an ejector tray 61, has elasped, the motor 2 is stopped. Since the original sensor 52 is kept in the ON condition so long as there is the original 1 in a supply tray 62, the motor 2 is driven to repeat the above-mentioned operation until there is no original 1 in the supply tray 62 and the original sensor 52 is turned OFF.

Figure 4:
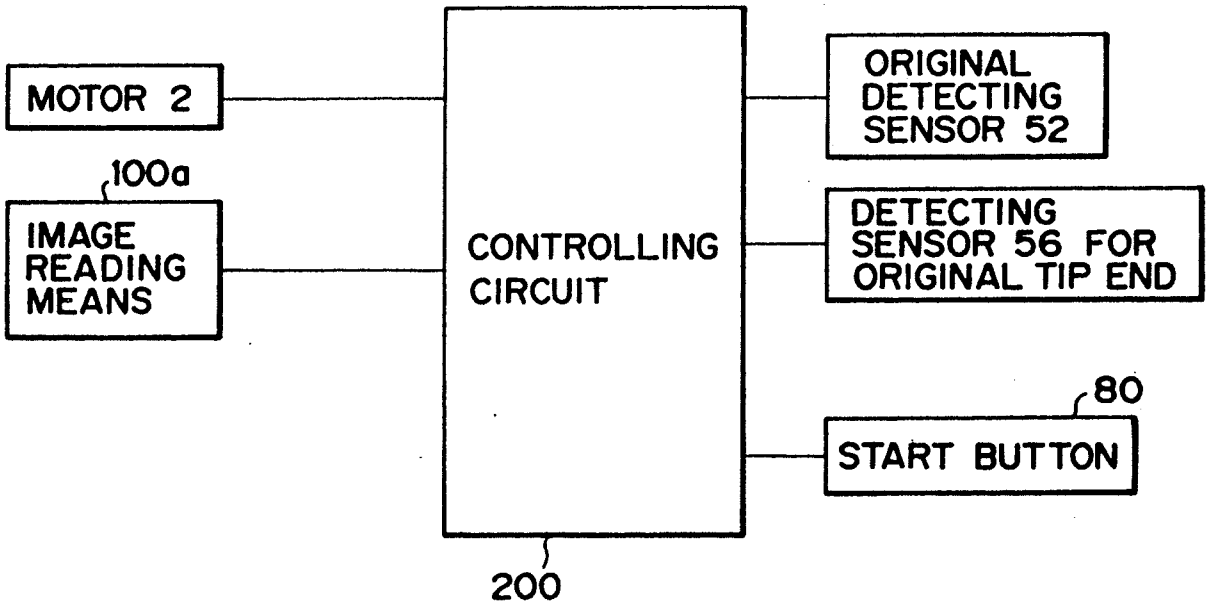
FIG. 4 is a block diagram of a control system of the sheet feeding apparatus of FIG. 1.
Figure 5A:
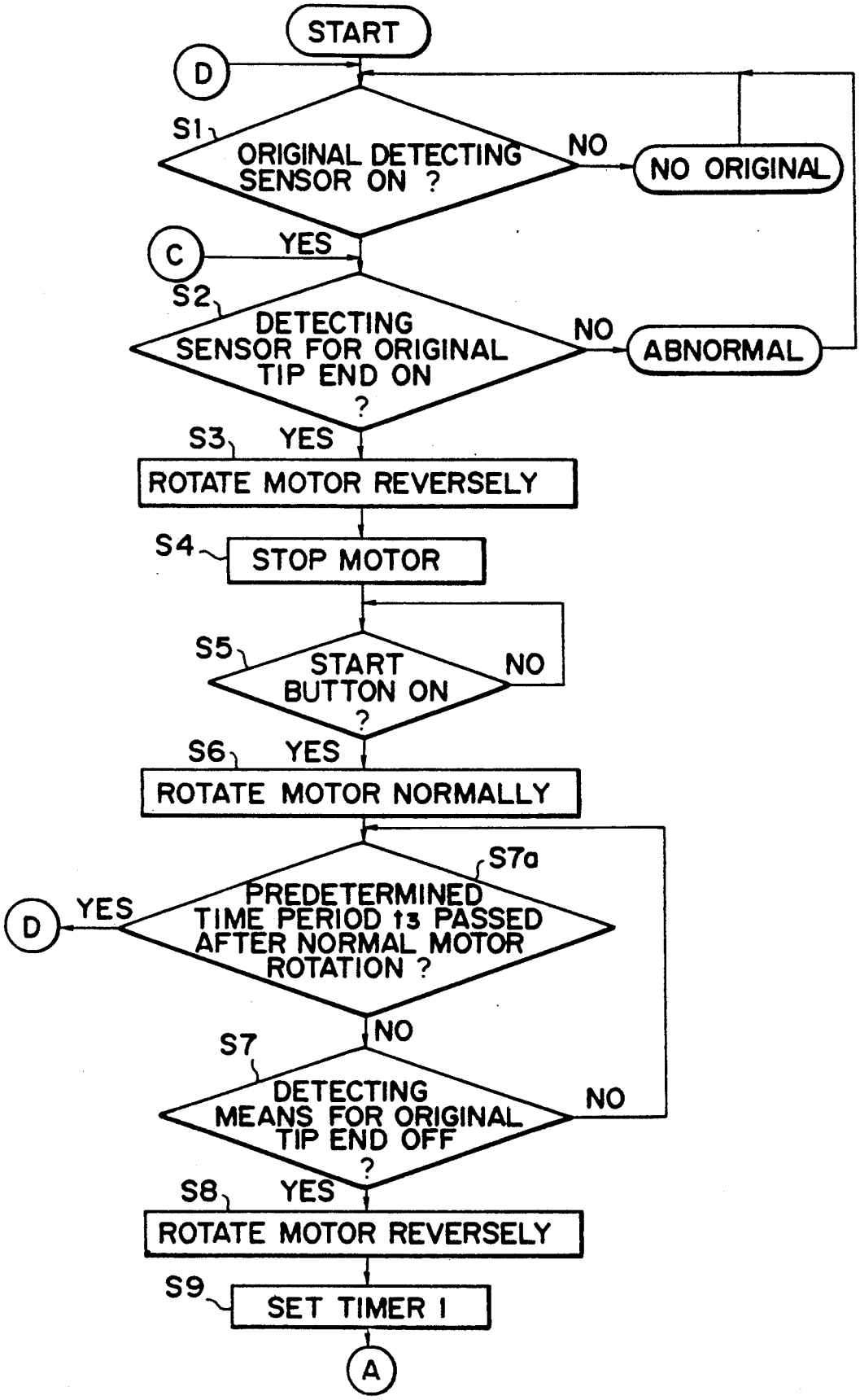
FIGS. 5A and 5B are flow charts showing an operation of the sheet feeding apparatus of FIG. 1.
Figure 5B:
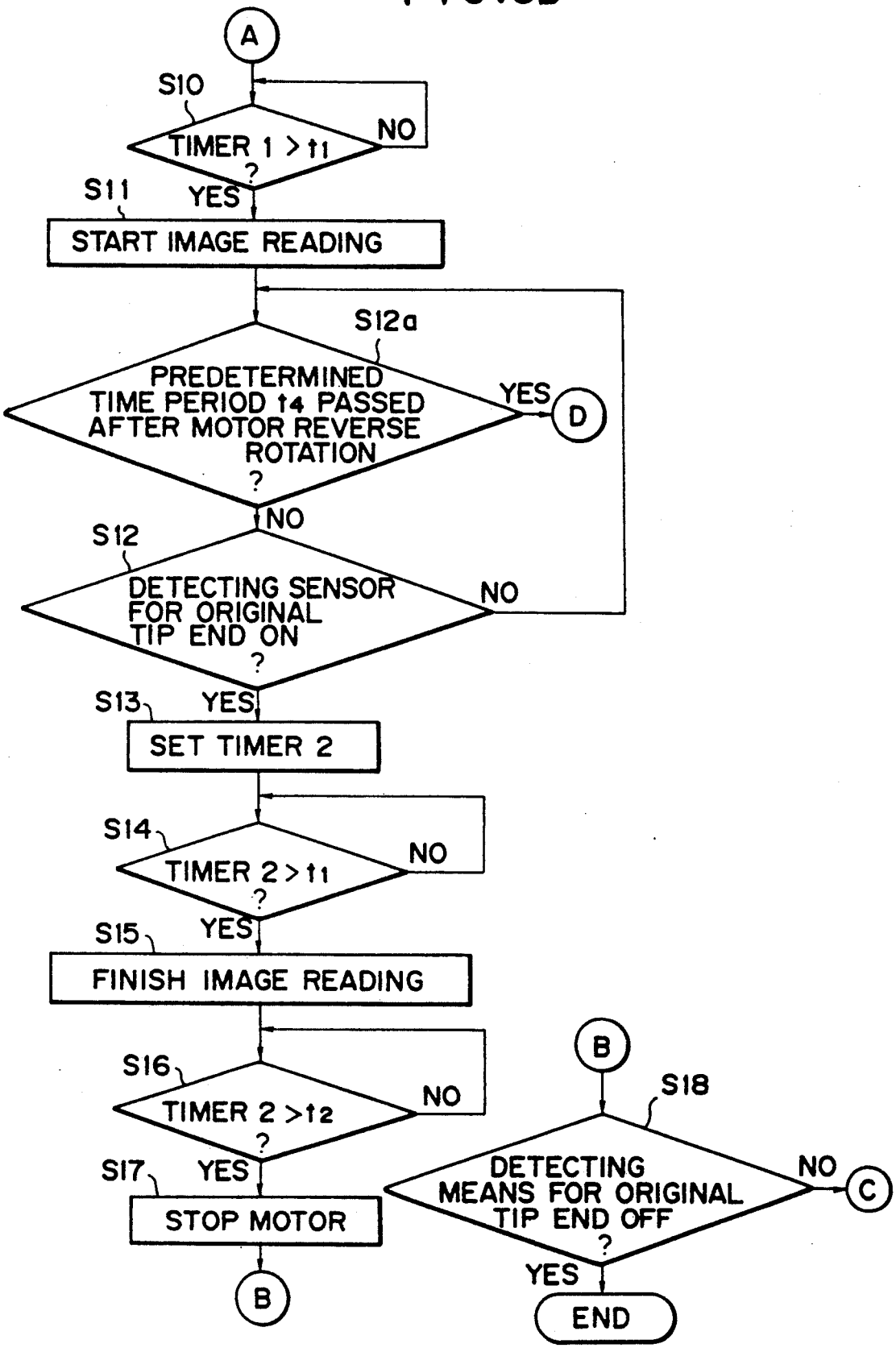

Next, the sequence of the above operation will be explained referring to a block diagram shown in FIG. 4 and the flow charts shown in FIGS. 5A and 5B. Reference numeral 200 in FIG. 4 denotes a control circuit.

In a step S1, if the original sensor 52 is turned OFF, the sensor judges the absence of the original, and the original feeding operation is not initiated, and the sequence returns to START. On the other hand, if the original sensor 52 is turned ON, the sequence goes to a step S2, where, if the original tip end detecting sensor 56 is turned OFF, it is judged that any original remains in the original feeding path, and the sequence returns to the START.

If the original sensor is turned ON (presence of original) and the original tip end detecting sensor 56 is also turned ON (none of jammed original), the sequence goes to a step S3, where the original feeding operation is started, and the motor 2 is rotated in the reverse direction for a predetermined time to lift the pick-up rollers 16. In a step S5, when the start button (not shown) is depressed, the motor is rotated in the normal direction to lower the pick-up rollers (in a step S6), thus starting the feeding of the original. When the leading edge of the original 1 is detected by the original tip end detecting sensor 56 (in a step S7), the rotational direction of the motor 2 is reversed (in a step S8), thus lifting the pick-up rollers 16 and setting a timer 1 (in a step S9). After a predetermined time $t_1$ has elasped as confirmed by the timer 1 (in a step S10), the image reading device 100 starts to read the image on the original (in a step S11).

After the trailing edge of the original has passed the original tip end detecting lever 54, the original tip end detecting sensor 56 is turned ON (in a step S12), and a timer 2 is set (in a step S13). After a predetermined time $t_2$ has elasped as confirmed by the timer 2 (in a step S14), the reading of the image by means of the image reading device 100 is finished. Further, after the predetermined time $t_2$ has elasped, the motor 2 is stopped (in a step S17). If the original sensor 52 is turned ON (i.e., there is a next original in the supply tray), the sequence returns to the step S2, where the original feeding operation is again started, and this feeding operation is repeated until the original sensor 52 is turned OFF. If the power source is shut off, for example, due to power stoppage, before the original 1 is detected by the original tip end detecting sensor 56 after the pick-up rollers 16 have been lowered and the original feeding operation has been started, the original 1 trapped in the original feeding path is removed. When the power source is restored (turned ON), the sequence returns to the step S1. When the original 1 is introduced into the entrance A, the original 1 is detected by the original sensor 52, the rotation of the motor is in the reverse direction (shown by the broken arrow in FIG. 2) to lift the pick-up rollers 16 to fully open the entrance A, thus ensuring a smooth insertion of the original 1.

Incidentally, in the step S1, the absence of the original is judged, the sequence returns to the START. Further, in the step S2, the jamming of the original is detected, the sequence returns to the START. Accordingly, until the jammed original is removed, the sequence will reciprocate between the step S2 and the START repeatedly. If the jammed original is removed, the sequence goes from the step S2 to the step S3.

In a step S7a, if the original tip end detecting sensor is not turned OFF by a predetermined time $t_3$ after the motor has been rotated in the normal direction to start the feeding of the original, that is to say, if the original does not reach the original tip end detecting sensor, it is considered that jamming of the original has occurred, and the sequence returns to the START. Then, the sequence goes to the steps S1-S3, thereby lifting the pick-up rollers 16, whereby the apparatus becomes a waiting condition in the step S5. Accordingly, by removing the jammed original in the waiting condition, when the start button is depressed again, the routine on and after the step S6 is executed normally as it is.

Also in a step S12a, if the trailing edge of the original is not passed through the original end tip detecting sensor by a predetermined time $t_4$ after the motor has been rotated in the reverse direction, it is considered that jamming of the original has occurred, and the sequence returns to the START. Also in this case, the sequence goes to the step S2, and then is repeated between the step S2 and the START, whereby the apparatus becomes a waiting condition, while the pick-up rollers 16 remain in the lifted condition.

In this way, in the illustrated embodiment, when jamming of the original occurs, the sequence always returns to the START. Once the jammed original is removed to restore the normal condition, the remainder sequence or routine is executed normally. Accordingly, it is needless to depress a reset button or to detect the completion of the jamming treatment by detecting the opening of a cover or guide members.

Further, in the illustrated embodiment, it is so designed that the presence of the original in the supply tray 62 is always detected or the original being stacked in the supply tray 62 are always detected, before the original feeding operation is started, and, on the basis of a detection signal, the pick-up rollers 16 are lifted. Accordingly, if the apparatus is stopped while the pick-up rollers 16 remain in the lowered condition, due to the abnormity such as the power stoppage, power OFF and the like, this situation causes no problem even when the originals remain in the supply tray 62, or even when the originals are restacked or new originals are stacked in the supply tray 62, on the basis of the detection signal since it is intended to supply the new original in the supply tray and the pick-up rollers 16 are lifted.

Incidentally, it should be noted that the present invention can be applied for feeding transfer papers to be copied, print papers and the like, other than the originals. Therefore, in this disclosure, the original, transfer paper, copy paper, print paper and the like are generically referred as "sheet" (or "sheet material").

Next, a second embodiment of the present invention will be explained.

Figure 6:
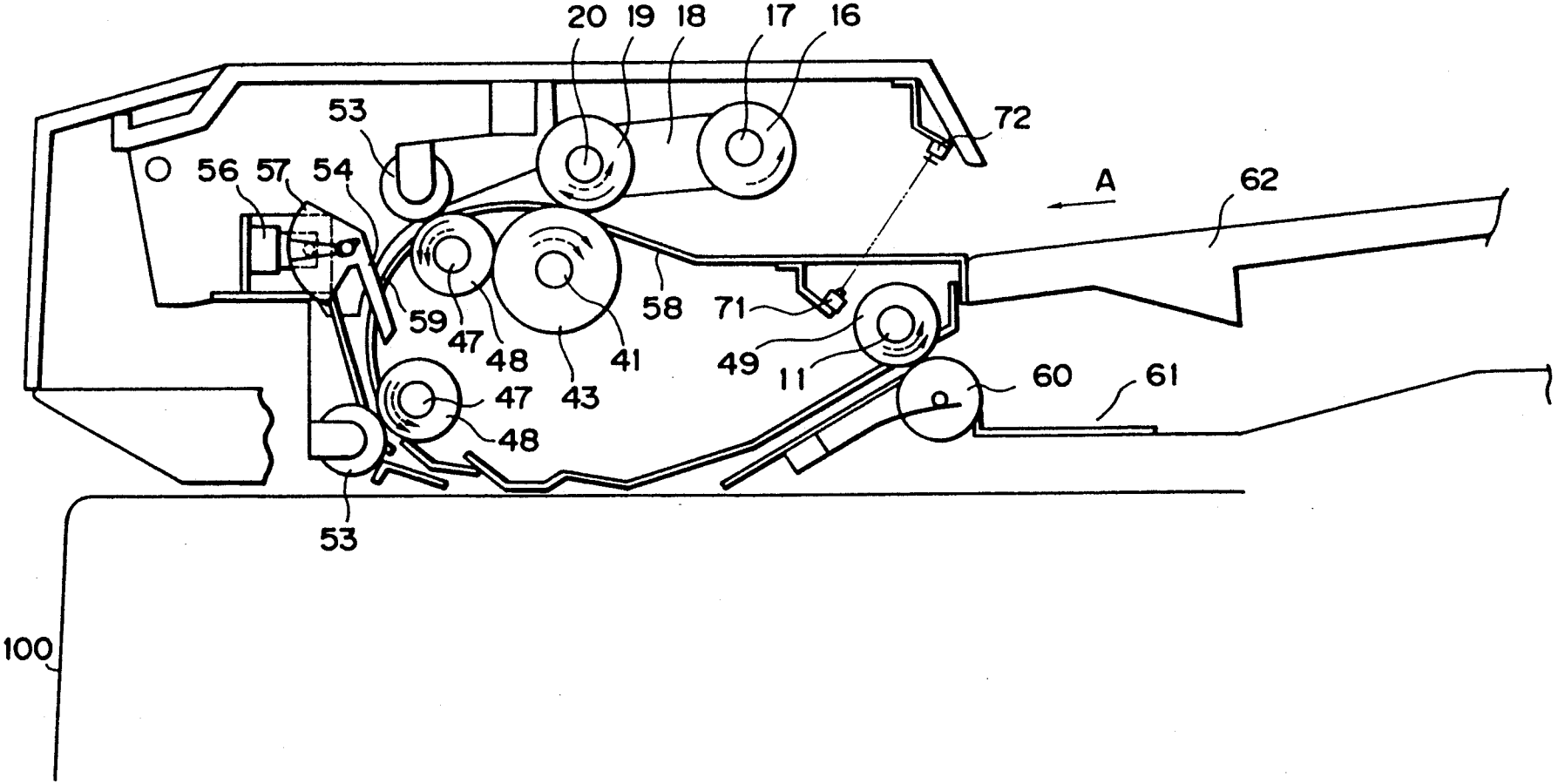
FIGS. 6 to 11 are views showing other embodiments of the present invention.

In the second embodiment, as shown in FIG. 6, a photodetector comprising a light emitter 71 and a light receiver 72 is arranged in the entrance A, in place of the original sensor 52. In this case, when the original is introduced into the entrance A, a light path from the light emitter 71 to the light receiver 72 is interrupted by the original, thereby detecting the presence the original 1, whereby the motor 2 is driven.

The operation of the sheet feeding apparatus according to the second embodiment is substantially the same as that of the previous or first embodiment.

According to the second embodiment, the following advantages are obtained:

(1) Since the original detecting means is arranged upstream of the pick-up rollers constituting the original supplying portion in the original feeding path, and the automatic original feeding means is activated in response to the emission of the signal representing the presence of the original, and the pick-up rollers are separated from the original to fully open the entrance when the original is introduced into the entrance, it is possible to insert the original smoothly.

(2) the up-and-down movement of the pick-up rollers can be obtained by changing the rotational directions of the motor, it is possible to lift and lower the pick-up rollers with a simple construction.

(3) Since the change-over of the motor can be effected by the original tip end detecting sensor, it is possible to reverse the motor without any specific detecting means and to construct the apparatus with simple mechanisms.

(4) It is possible not only to change over the rotational directions of the motor but also to detect the presence of the original by a single detecting sensor.

Next, a third embodiment of the present invention will be explained.

Figure 7:
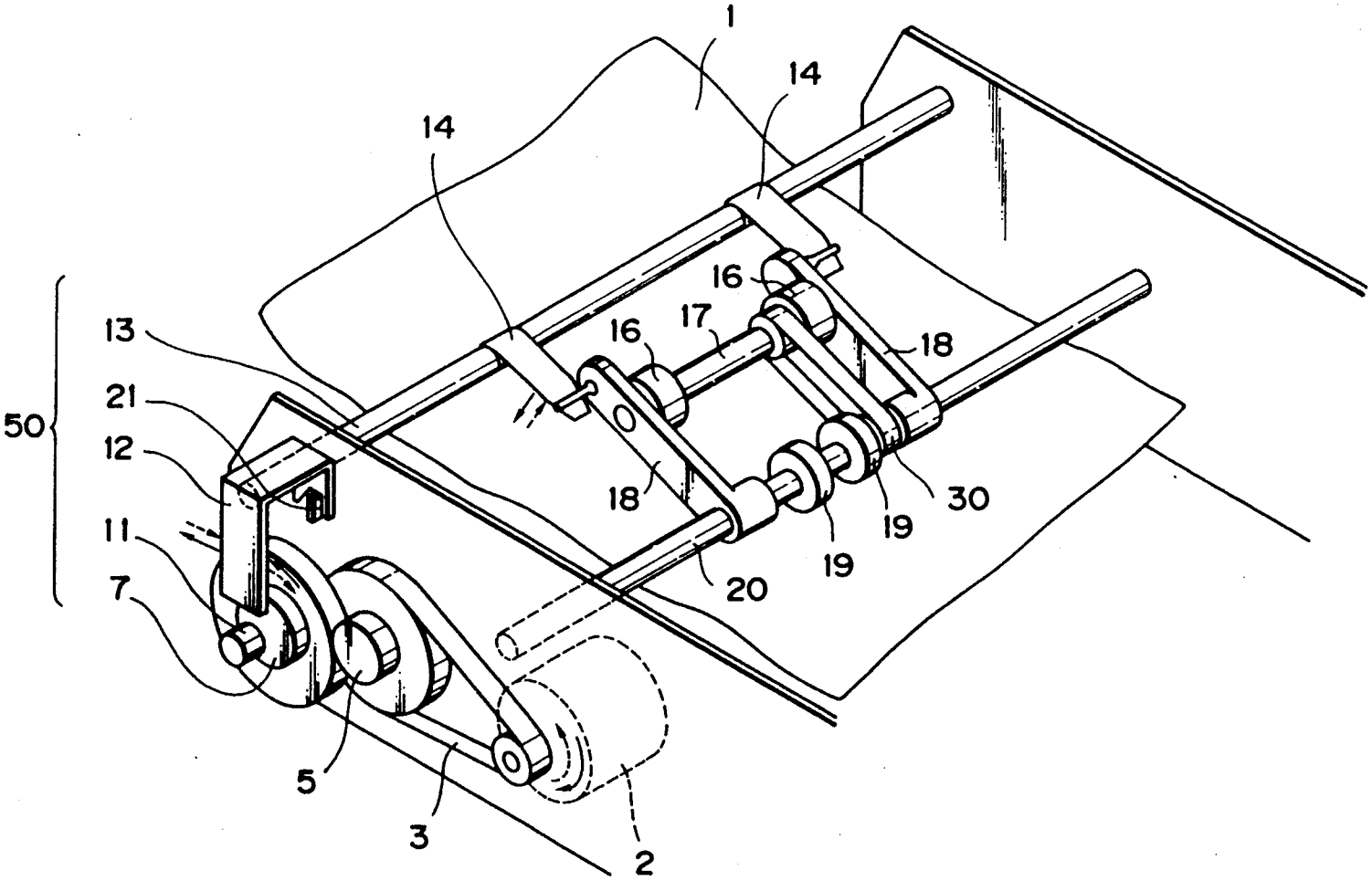

In the third embodiment, as shown in FIG. 7, the rocking plate 12 is made of elastic material having a spring feature so that the rocking plate 12 itself is pressed against the friction pad 7. In this case, the friction link 8 is omitted. The rotation of the gear 6 is transmitted directly from the friction pad 7 to the rocking plate 12, thus converting the rotational movement of the gear 6 into a reciprocal movement of the rocking plate. The reciprocal movement of the rocking plate 12 is converted into the up-and-down movement of the pickup rollers 16 through the rocking shaft 13, support plates 14 and arm 18.

The operation and the control sequence of the sheet feeding apparatus according to the third embodiment are substantially the same as those of the first embodiment previously described.

Next, a fourth embodiment of the present invention will be explained.

FIGS. 8 to 11 show a further embodiment wherein a means for transmitting the driving force to the support plates 14 is altered.

Figure 8:
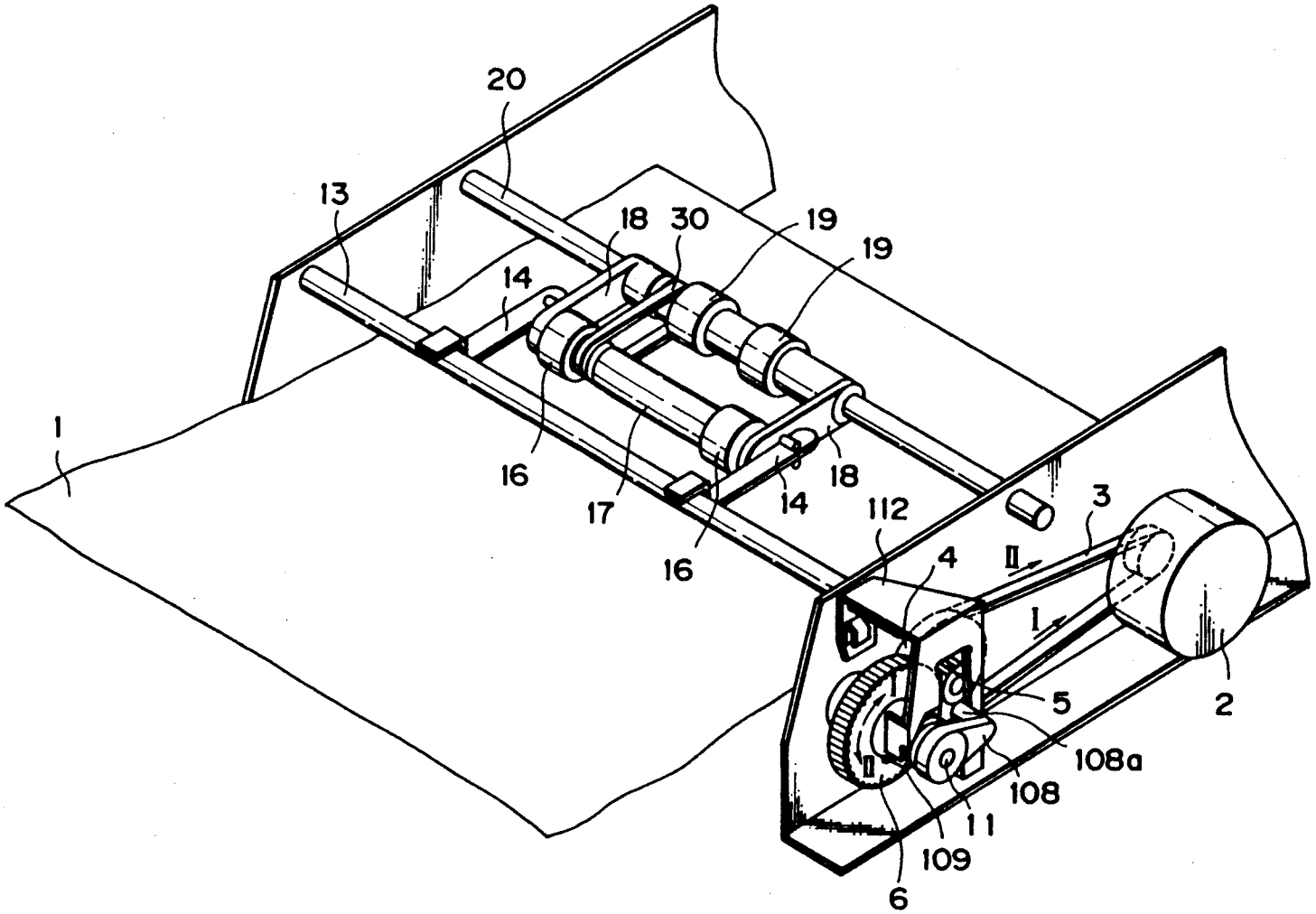
Figure 9:
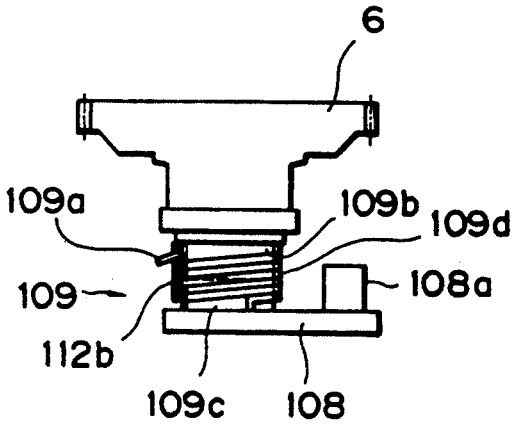
Figure 10:
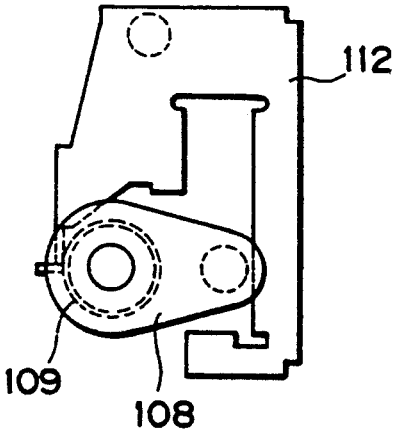
Figure 11:
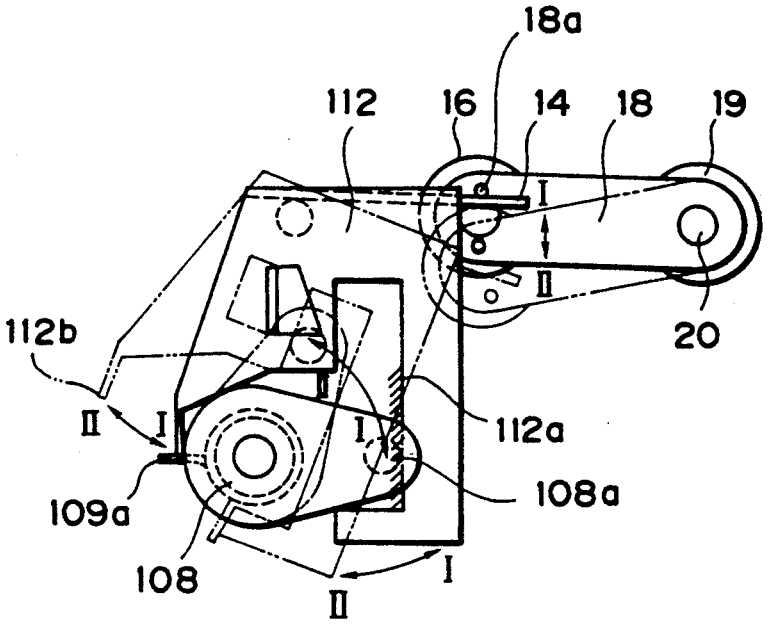

In FIG. 8, the reference numeral 108 denotes a rocking arm rotatably mounted on the ejector roller shaft 11, which rocking arm 108 is connected to the gear 6 through a spring clutch 109. When the gear 6 is rotated in a direction I (FIG. 8), the spring clutch 109 is placed under a tensioned condition, thus transmitting the driving force to the rocking arm 108. On the other hand, when the gear 6 is rotated in a direction II (FIG. 8), the spring clutch 109 is placed under a slacked condition, whereby the spring clutch is idly driven while affecting a slight release torque to the rocking arm 108.

The reference numeral 13 denotes a rocking shaft rotatably supported by a frame of the apparatus; and 112 denotes a rocking member attached to the rocking shaft 13. A pin **108*a* formed on the rocking arm 108 can slide while abutting against an end face 112*a* of the rocking member 112, thus rocking the rocking member 112. Consequently, the support plate 14 fixed to the rocking shaft 13** are rocked.

When the support plates 14 are rocked to rock the arms 18, the pick-up rollers 16 are shifted toward and away from the original. In a position where the pick-up rollers 16 are separated from the original by rotating the gear in the direction I, an end face **112*b* of the rocking member 112 abuts against an end face 109*a* of the spring clutch 109, thus placing the spring clutch under the slacked condition, whereby the spring clutch is released from a clutch barrel or body to disconnect the clutch. In this point, a line connecting between a pivot centre of the rocking arm 108 and a sliding point of the pin 108*a* forms an angle of 90° with respect to the end face 112*a* of the rocking member 112**.

The spring clutch 109 comprises a first drum **109*b* fixed to the gear 6, a second drum 109*c* fixed to the rocking arm 108, and a coil spring 109*d* wound around the first and second drums 109*b*, 109*c*. When the gear is rotated in the direction I, the coil spring 109*d* tightens the first and second drums 109*b*, 109*c* to rotate therewith, thereby transmitting the torque. When the gear 6 is rotated in the direction II, the coil spring 109*d*** is slacked, and, thus, the coil spring contacts the first and second drums only by the spring force of the coil spring itself, whereby the coil spring transmits a small torque to the drums or slips on the drums.

In the illustrated embodiment, with the arrangement as mentioned above, when the leading edge of the original 1 is introduced into the entrance A, the original detecting lever 51 attached to the rocking shaft 13 is rotated in an anti-clockwise direction, whereby the original sensor 52 detects the presence of the original, thereby rotating the pulse motor 2 in the reverse direction corresponding to the direction I. The rotation of the pulse motor 2 is transmitted to the gear 6 through the belt 3, pulley 4 and gear 5. By the spring clutch 109 which can transmit the driving force only in this direction, the rotation of the gear 6 is transmitted to the rocking arm 108, thus rotating the latter in a clockwise direction, whereby the rocking member 112 is rotated in a direction where the support plates 14 fixed to the rocking shaft 13 are lifted. Consequently, the arms 18 are also lifted, thus shifting the pick-up rollers 16 supported by the arms 18 to a retarded position (position shown by the solid line in FIG. 11).

In this point, the end face 112*b* of the rocking member abuts against the end 109*a* of the spring clutch 109, thus slacking the spring clutch 109. In this condition, although the gear 6 having the clutch barrel attached thereto continues to rotate in the direction I, an inner surface the coil spring 109*d* slippingly contacts an outer surface of the clutch barrel with a weak friction force. By such slip, the transmission of the driving force to the rocking arm 108 is interrupted, thus maintaining the retarded position of the pick-up rollers, where these rollers are separated from the original, thereby ensuring the original suppliable condition.

In this way, when the originals 1 are stacked in the supply tray, the start button (not shown) is depressed. The control portion receiving a start signal from the start button activates the pulse motor 2 to rotate the belt 3 in the normal direction corresponding to the direction II. The rotation of the pulse motor 2 is transmitted to the gear 6 through the belt 3, pulley 4 and gear 5. In this direction II, the spring clutch 109 is idly driven while transmitting the driving force of the gear 6 to the rocking arm 108 only by a small torque amount. Now, the weight of the pick-up rollers acts on the rocking member 112 so that the rocking member is rotated in the direction II through the support plates 14 and the rocking shaft 13. When the rocking arm 108 is rotated slightly in the direction II by the above-mentioned small torque from the gear 6, the locking member 112 is rocked smoothly until the pick-up rollers 16 are engaged by the original (shown by the two-dot and chain line in FIG. 11).

In this way, in the illustrated embodiment, the lifting of the pick-up rollers 16 can be effected with the least driving force and the lowering of the pick-up rollers 16 can be effected by the small torque in the slacked condition of the spring clutch 109 and the weight of the pick-up rollers 16 themselves. Accordingly, the load acting on the pulse motor 2 can be minimized, and the loss of energy can be prevented unlike the case where the friction clutch is used for converting the driving energy into thermal energy.

What is claimed is:

1. A sheet feeding apparatus comprising:

a supporting means for supporting stacked sheets;

a feed means for feeding the sheets stacked in said supporting means when contacted therewith;

a separating means for separating the sheets fed by said feed means so that the sheets are fed one by one;

a shifting means for shifting said feed means between a first position where said feed means contacts a sheet stacked in said supporting means to feed it and a second position where said feed means is separated from the sheet to form a gap therebetween;

a drive means for driving said shifting means;

a detecting means disposed upstream of said feed means for detecting the fact that the sheet is being stacked in said supporting means; and a control means for controlling said shifting means so that said feed means is shifted to said second position for facilitating advancement of a leading edge of the sheet from said supporting means when said detecting means detects the sheet.

2. A sheet feeding apparatus according to claim 1, wherein said feed means comprising a rotary member for applying a feeding force to said sheet while contacting said sheet.

3. A sheet feeding apparatus according to claim 1, wherein said control means permits the feeding of the sheet by means of said feed means while in a first position, only after said feed means has first been shifted to said second position on the basis of the detection of said detecting means.

4. A sheet feeding apparatus comprising:

a supporting means for supporting stacked sheets;

a feed means for feeding the sheets stacked in said supporting means when contacted therewith;

a separating means for separating the sheets fed by said feed means so that sheets are fed one by one;

a shifting means for shifting said feed means to a first position where said feed means contacts the sheet stacked in said supporting means and for shifting said feed means to a second position where said feed means are separated from the sheet stacked in said supporting means;

a drive means for generating rotational forces in a predetermined direction and in a direction opposite thereto, and causing said shift means to shift said feed means to the first position by rotational force in the predetermined direction and causing said shift means to shift to the second position by the rotational force in the opposite direction;

a detecting means disposed upstream of said feed means for detecting the fact that the sheet is stacked in said supporting means; and a control means for controlling said drive means to generate the rotational force in the opposite direction so that said feed means is shifted to said second position for facilitating advancement of a leading edge of the sheet from said supporting means when said detecting means detects the sheet.

5. A sheet feeding apparatus according to claim 4, wherein said feed means comprises a rotary member for applying a feeding force to said sheet while contacting said sheet.

6. A sheet feeding apparatus according to claim 4, wherein said control means permits the feeding of the sheet by means of said feed means while in a first position, only after said feed means has first been shifted to said second position on the basis of the detection of said detecting means.

7. A sheet feeding apparatus comprising:

a supporting means for supporting stacked sheets;

a feed means for feeding the sheets stacked in said supporting means;

a driving means for generating rotational forces in a predetermined direction and in an opposite direction opposite thereto;

a shifting means operated by said rotational force in the predetermined direction for shifting said feed means to a first position where said feed means contacts the sheet stacked in said supporting means, and operated by said rotational force in the opposite direction for shifting said feed means to a second position where said feed means is separated from the sheet stacked in said supporting means;

a convey means for conveying the sheet fed out by said feed means;

a first transmission route for transmitting the rotational force of said predetermined direction generated at said driving means to convey means to thereby convey the sheet downstream; and a second transmission route for transmitting the rotational force of said opposite direction generated at said driving means to said convey means to thereby convey the sheet downstream.

8. A sheet feeding apparatus according to claim 7, wherein said shifting means supports said feed means at one end and comprises a rocking member rockable around the other end.

9. A sheet feeding apparatus according to claim 7, wherein said convey means includes rotary members for nipping and conveying the sheet.

10. A sheet feeding apparatus according to claim 7, wherein each of said first and second transmission route includes a one-way clutch.

11. A sheet feeding apparatus according to claim 7, further including a driving force transmitting means for transmitting the rotational force in a predetermined direction by a first predetermined value, and for transmitting the rotational force in a direction opposite thereto by a second value which is larger than the first predetermined value whereby said feed means is shifted by the rotational force transmitted by said driving force transmitting means.

12. A sheet feeding apparatus according to claim 7, further including a detecting means disposed upstream of said feeding means for detecting the fact that the sheet is stacked in said supporting means, and a control means for controlling said shifting means to shift said feed means to the second position when said detecting means detects the sheet.

13. A sheet feeding apparatus according to claim 7, wherein said convey means includes separating means for separating the sheets fed out from said feeding means one by one.

14. A sheet feeding apparatus according to claim 13, wherein said separating means is comprised of a feeding roller rotating in a direction so as to feed the sheet downstream and a separating roller rotating in a direction to return a sheet of at least two sheets to be separated so that said at least two sheets to be separated are nipped by said feeding roller and separating roller, said separating roller always rotating in the direction so that said sheet to be separated is returned upstream, by applying to said separating roller the force from said driving means.

15. A sheet feeding apparatus according to claim 14, wherein said separating roller is connected to said first transmission route.

16. A sheet feeding apparatus according to claim 14, wherein said separating roller is connected to said second transmission route.

17. An image reading apparatus comprising:

a supporting means for supporting stacked sheets;

a feed means for feeding the sheets stacked in said supporting means;

an image reading means for reading an image on said sheet fed by said feeding means;

a driving means for generating rotational forces in a predetermined direction and in an opposite direction opposite thereto;

a shifting means operated by said rotational force in the predetermined direction for shifting said feed means to a first position where said feed means contacts the sheet stacked in said supporting means, and operated by said rotational force in the opposite direction for shifting said feed means from the sheet stacked in said supporting means to a second position where said feed means is separated;

a convey means for conveying the sheet fed out by said feed means;

a first transmission route for transmitting the rotational force of said predetermined direction generated at said driving means to said convey means to thereby convey the sheet downstream; and a second transmission route for transmitting the rotational force of said opposite direction generated at said driving means to said convey means to thereby convey the sheet downstream.

18. A sheet feeding apparatus comprising:

a supporting means for supporting the stacked sheets;

a feed means for feeding the sheets stacked in said supporting means;

a driving means for generating rotational forces in a predetermined direction and in an opposite direction opposite thereto;

a shifting means for utilizing said rotational force in the predetermined direction to shift said feed means to a position where said feed means contacts the sheet stacked in said supporting means and for utilizing said rotational force in the opposite direction to separate said feed means from the sheet stacked in said supporting means;

a first driving force transmitting means for transmitting the rotational force of the predetermined and the opposite directions which are generated at said driving means to said shifting means;

a second driving force transmitting means for transmitting the rotational force generated at said driving means to said feed means;

convey means for conveying the sheet fed out by said feed means; and actuator means for actuating said convey means to convey the sheet to a downstream side by applying the rotational forces of predetermined and opposite directions.

19. A sheet feeding apparatus according to claim 18, wherein said conveying means includes separating means for separating the sheets fed out from feeding means one by one.

20. A sheet feeding apparatus according to claim 19, wherein said separating means is comprised of a feeding roller rotating in a direction so as to feed the sheet downstream and a separating roller rotating in a direction to return a sheet of at least two sheets to be separated so that said at least two sheets to be separated are nipped by said feeding roller and separating roller, said separating roller always rotating in the direction so that said sheet to be separated is returned upstream, by applying to said separating roller the force from said driving means.

21. An image reading apparatus comprising:

a supporting means for supporting stacked sheets;

a feed means for feeding the sheets stacked in said supporting means;

a separating means for separating the sheets fed by said feed means so that the sheets are fed one by one;

an image reading means for reading an image on the sheet fed by said feeding means;

a shifting means for shifting said feed means between a first position where said feed means contacts the sheet stacked in said supporting means and a second position where said feed means is separated from the sheet;

a drive means for driving said shifting means;

a detecting means disposed upstream of said feed means for detecting the fact that the sheet is being stacked in said supporting means; and a control means for controlling said shifting means so that said feed means is shifted to said second position for facilitating advancement of a leading edge of the sheet from said supporting means when said detecting means detects the sheet.

* * * * *

UNITED STATES PATENT AND TRADEMARK OFFICE

CERTIFICATE OF CORRECTION

PATENT NO. : 5,209,465

DATED : May 11, 1993

INVENTOR(S) : HIDEAKI SAYAMA, ET AL.

It is certified that error appears in the above-indentified patent and that said Letters Patent is hereby corrected as shown below:

COLUMN 1

Line 32, "cases," should read --case,--.

COLUMN 4

Line 50, "rotating" should read --rotating,--.

COLUMN 6

Line 39, "S1, the" should read --S1, if the--.
Line 41, "S2, the" should read --S2, if the--.
Line 56, "becomes" should read --enters--.

COLUMN 7

Line 1, "becomes" should read --enters--.
Line 6, "remainder" should read --remaining--.
Line 23, "62, on" should read --62, since on--.
Line 24, "since" should be deleted.

UNITED STATES PATENT AND TRADEMARK OFFICE

CERTIFICATE OF CORRECTION

PATENT NO. : 5,209,465 Page 2 of 2

DATED : May 11, 1993

INVENTOR(S) : HIDEAKI SAYAMA, ET AL.

It is certified that error appears in the above-indentified patent and that said Letters Patent is hereby corrected as shown below:

COLUMN 9
Line 47, "locking" should read --rocking--.

COLUMN 11
Line 3, "opposite" should be deleted.
Line 30, "route" should read --routes--.
Line 43, "feeding" should read --feed--.
Line 50, "feeding" should read --feed--.

COLUMN 12
Line 6, "feeding" should read --feed--.
Line 9, "opposite" should be deleted.
Line 57, "conveying" should read --convey--.
Line 58, "feeding" should read --said feed--.

COLUMN 13
Line 11, "feeding" should read --feed--.

Signed and Sealed this

Twenty-first Day of June, 1994

Bruce Lehman

*Attest:*

BRUCE LEHMAN

*Attesting Officer*

*Commissioner of Patents and Trademarks*